US006099204A

United States Patent [19]

Godbersen

[11] Patent Number: 6,099,204

[45] Date of Patent: Aug. 8, 2000

[54] APPARATUS FOR INSERTING DOWEL BARS IN A CONCRETE SLIP FORMING MACHINE

[76] Inventor: Gary L. Godbersen, 511 Court St., Ida Grove, Iowa 51445

[21] Appl. No.: 08/689,795

[22] Filed: Aug. 13, 1996

[51] Int. Cl.[7] ..... E01C 23/04

[52] U.S. Cl. ..... 404/88; 404/100

[58] Field of Search ..... 404/87, 88, 100, 404/105, 114

[56] References Cited

U.S. PATENT DOCUMENTS

| | | | |
|---|---|---|---|
| 2,295,947 | 9/1942 | Heltzel . | |
| 4,433,936 | 2/1984 | Moser . | |
| 4,798,495 | 1/1989 | Laeuppi et al. . | |
| 4,799,820 | 1/1989 | Laeuppi et al. . | |
| 5,190,397 | 3/1993 | Bengford et al. . | |
| 5,209,602 | 5/1993 | Godbersen . | |
| 5,318,377 | 6/1994 | Swisher, Jr. et al. | 404/88 X |

FOREIGN PATENT DOCUMENTS 3811186 of 1989 Germany .

OTHER PUBLICATIONS

Copy of ten page brochure entitled HW–165 Slipform Paver by Gomaco Corporation.

Copy of two page brochure entitled DBI 650 Dowel Bar Inserter by Gomaco Corporation.

Copy of two page brochure entitled Gomaco DBI 650 by Gomaco Corporation, dated 1984.

Copy of eight page brochure entitled GP–2500 Full–width Slipform Paver by Gomaco Corporation, dated 1987.

*Primary Examiner*—James Lisehora

[57] ABSTRACT

An apparatus for inserting dowel bars into a concrete slab in association with a slip forming machine of a type having a frame with a pan attached thereto for shaping uncured concrete into a continuous concrete slab. The pan itself has a space therein completely across the pan and dowel bar retainers are disposed above this space in the pan for holding dowel bars in readiness to be inserted into the concrete slab. A dowel bar inserter is disposed above each of the dowel bar retainers for pushing the dowel bars down, preferably all at one time. The dowel bar inserter is adjustable and removable. If removed, the forward and rear portions of the pan can be bolted together instead of being spaced apart.

9 Claims, 5 Drawing Sheets

APPARATUS FOR INSERTING DOWEL BARS IN A CONCRETE SLIP FORMING MACHINE

TECHNICAL FIELD

The present invention relates generally to an apparatus for slip forming of concrete using a pan which initially begins the concrete forming process of such a machine and to an apparatus for inserting dowel bars for a concrete slip forming machine, and more particularly to such a method and apparatus which inserts dowel bars directly between spaced apart portions of the pan of such machine, instead of utilizing a separate dowel bar insertion device disposed behind the pan, which has been the custom of the prior art.

BACKGROUND ART

In concrete slip forming machines used for building roads and the like, it is customary to form joints therein at predetermined intervals. One of the reasons for these joints is to hold adjacent sections of concrete together while at the same time allowing for them to shift to some extent, which occurs during freezing and thawing cycles. These dowel bars are typically inserted all the way across the pavement being formed and generally are aligned with the forward movement of the machine. These joints can be perpendicular to the slab and to the direction of forward movement of the machine or they can extend across the strip of concrete being formed at an angle thereto, which is commonplace in present day road construction so that each set of tires of a vehicle does not hit the joint at precisely the same time, thereby lessening the thumping problem that often occurs when the concrete joints are perpendicular to the direction of the movement of the vehicle traveling thereon.

The aforementioned concrete slip forming machines have for many years used dowel bar insertion mechanisms thereon, for example like those shown in U.S. Pat. Nos. 4,798,495 and 4,799,820, both by Laeuppi, et al., both of which are incorporated herein by reference.

Conventional dowel bar inserting equipment is attached to the frame of a slip forming machine behind the pan, for example as shown in U.S. Pat. No. 5,190,397 to Bengford, which patent is incorporated herein by reference. By utilizing this prior art technology with the dowel bar insertion mechanism being behind the pan, the concrete slab which has already been formed, shaped and smoothed by the pan is disturbed considerably by the insertion of the dowel bars therein, which creates a need for an additional trowel following the dowel bar insertion mechanism. Such a trowel is shown in U.S. Pat. No. 5,061,115 to Godbersen, et al. Also, a vibrating screed or correcting beam precedes the trowel on such a machine.

The need to have this dowel bar inserting apparatus and accompanying trowel mechanism makes it necessary to lengthen the machine by a considerable amount. This additional length creates many problems such a making the machine more difficult to move and requiring much more time to assemble and disassemble as these machines are moved from one job site to the other. Additionally, on roads that have sharp vertical curves up or down, if the paver is too long, it can extend completely across such a low spot and not be capable of reaching low enough to correctly pave the surface thereunder or it can extend completely across the high spot leaving only a thin layer of concrete. Furthermore, a machine which has a conventional dowel bar inserting thereon and a follow-up trowel mechanism almost always needs to be a four-track machine, which increases the costs of manufacture and use over that of a two-track machine, and also causes the aforementioned problem relating to the difficulty of being able to pave roads which have sharp vertical curves up and down.

U.S. Pat. No. 5,209,602, issued May 11, 1993 to Gary L. Godbersen, solved many of the aforementioned problems. The present invention is an improvement thereto since it has been determined that it is better to form a wide space in the pan than to merely have openings which extend therethrough for inserting dowel bars.

Consequently, there is a need for a method and apparatus for inserting dowel bars on a concrete slip forming machine which will overcome the aforementioned disadvantages of the prior art.

DISCLOSURE OF THE INVENTION

The present invention relates generally to an apparatus for inserting dowel bars into a concrete slab in association with a slip forming machine of a type having a frame with a pan attached thereto for shaping uncured concrete into a continuous concrete slab. The pan itself has a space disposed therein completely across the pan and dowel bar retainers are disposed above this space in the pan for holding dowel bars in readiness to be inserted into the concrete slab. A dowel bar inserter is disposed above each of the dowel bar retainers for pushing the dowel bars down, preferably all at one time.

An object of the present invention is to provide an improved method and apparatus for inserting dowel bars into a concrete slab in association with the use of a concrete slip forming machine.

Another object of the present invention is to provide a dowel bar inserting apparatus which does not disturb the concrete slab after it has been formed by the pan of a slip forming machine.

A still further object of the present invention is to provide a dowel bar inserting apparatus which eliminates the need for further troweling of the top of the concrete slab of a slip forming machine after dowel bars have been inserted.

A still further object of the present invention is to provide a dowel bar inserting apparatus which permits a slip forming machine to be much shorter and also permits such a machine to be a two-track machine instead of a more awkward and expensive four-track machine.

A still further object of the present invention is to provide a concrete slip forming machine with a dowel bar insertion apparatus disposed above a space between front and rear portions of the pan.

A still further object is to provide an apparatus of the aforementioned type which has a device for adjusting the distance between dowel bars and the distance between insertion forks so that an entirely different pan does not need to be used as would be the case if different distances between dowel bars were required in the above mentioned '602 patent.

Still another object of the invention is to provide an apparatus which can have the aforementioned objects achieved and still have a arrangement where a dowel bar inserter can be used or not used in a split pan arrangement.

Other objects, advantages, and novel features of the present invention will become apparent from the following detailed description of the invention when considered in conjunction with the accompanying drawings.

BEST MODE FOR CARRYING OUT THE INVENTION

Figure 1:
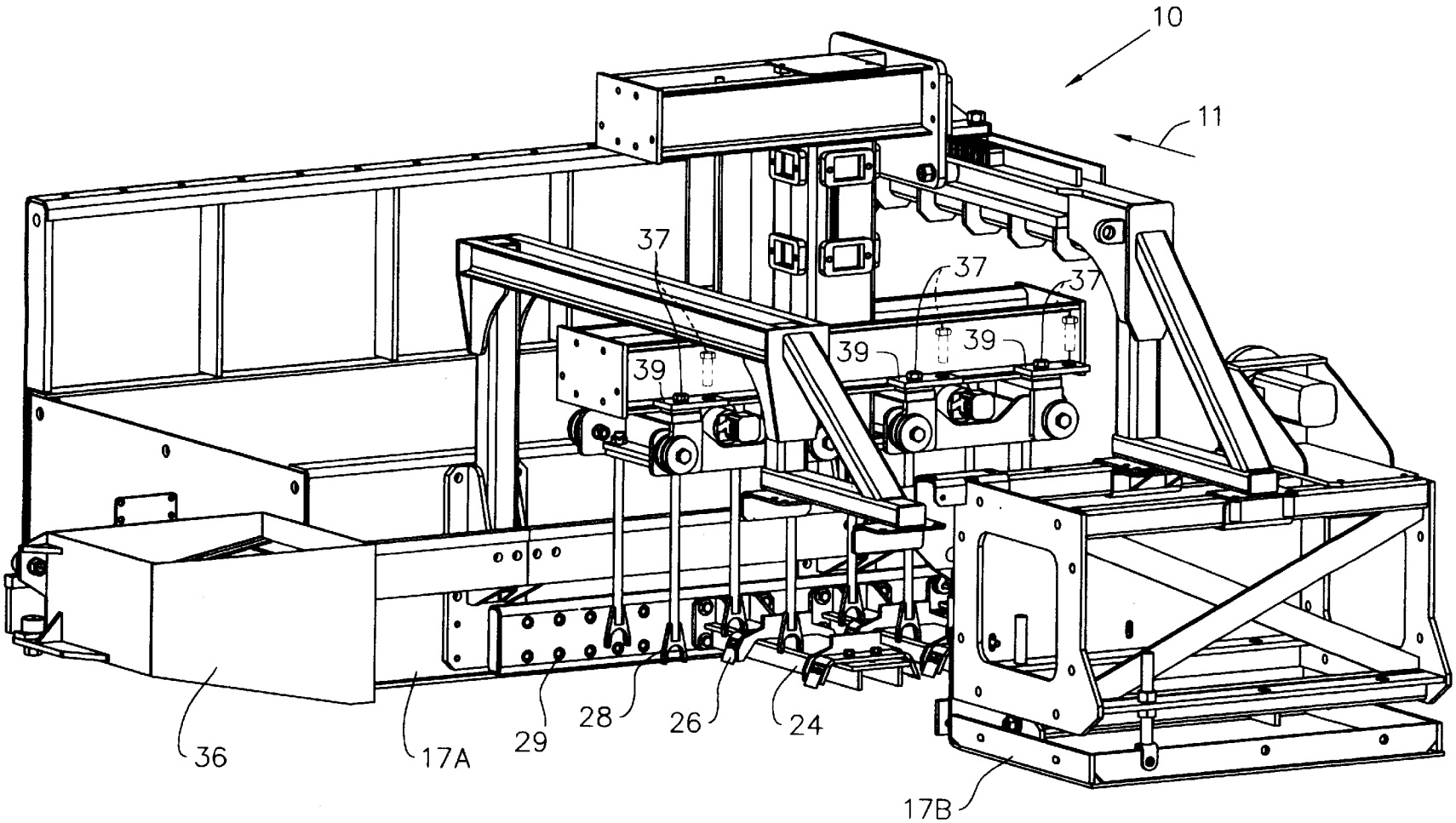
FIG. 1 is perspective view of a portion of one-half of a preferred embodiment of the invention with one section of the rear portion of the pan removed.
Figure 2:
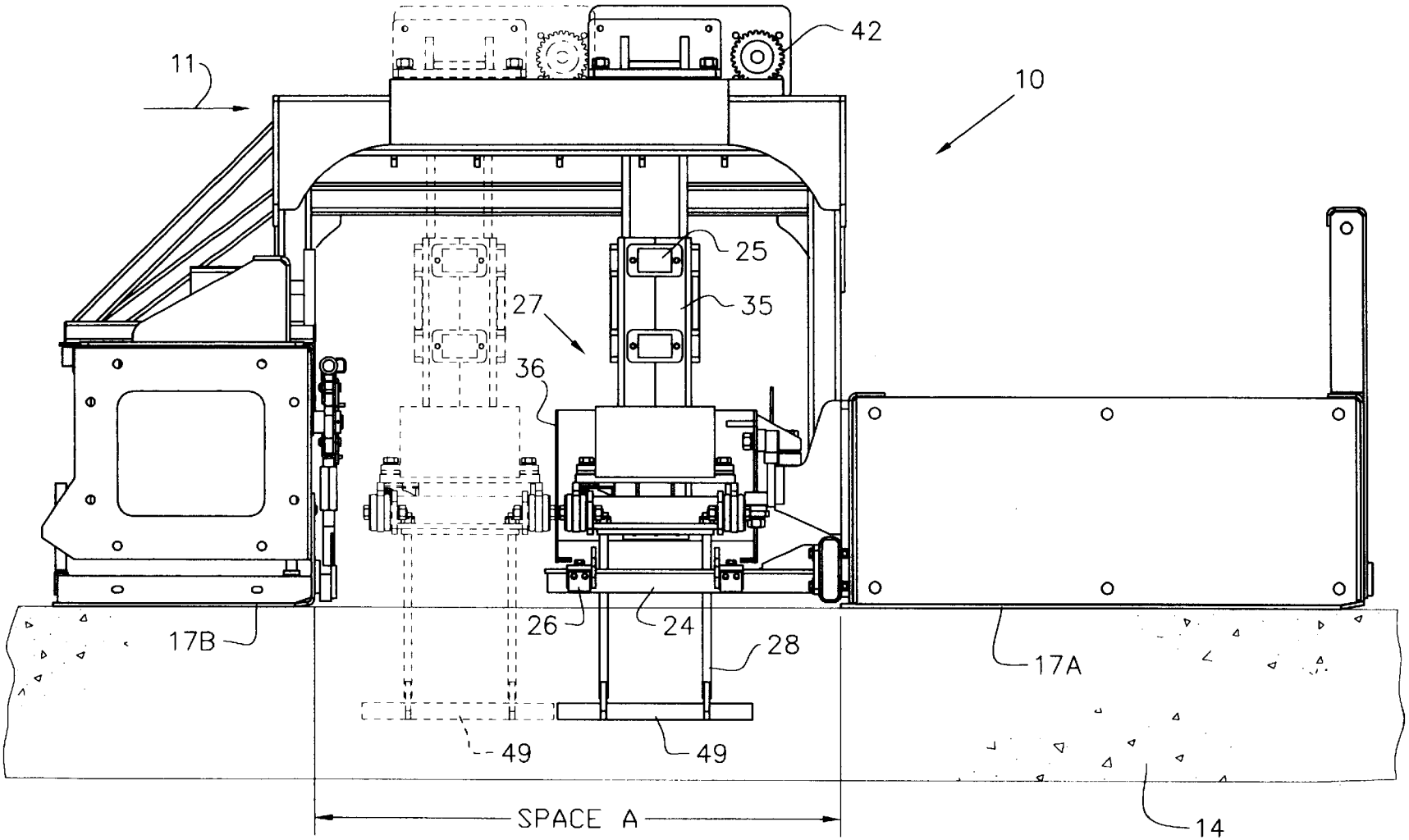
FIG. 2 is a right side elevational view of the machine shown in FIG. 1.

Referring now to the drawings wherein like reference numerals designate identical or corresponding parts throughout the several views, FIG. 1 shows the relevant parts of a slip forming machine (10) constructed in accordance with the present invention and having a front pan forming surface (17A) and a rear pan concrete forming surface (17B) which are spaced apart by gap A therebetween as clearly shown in FIG. 2. Between the space A shown in FIG. 2 is a dowel bar insertion mechanism (27) formed essentially by a cart (36) of the type shown in U.S. Pat. No. 5, 209,602 to Godbersen, which is incorporated herein by reference and U.S. Pat. No. 5, 190,397 to Bengford, et al., which is also incorporated herein by reference. This structure shown is constructed more like the Bengford, et al., device except that in the preferred embodiment, the dowel bars are inserted in a straight line across the slab instead of staggered as shown in both the Bengford, et al, and the Godbersen preferred embodiments of the aforementioned patents.

As the slip forming machine moves forwardly, for example as shown by arrows 11 in FIGS. 2–3 and looking most particularly at FIG. 2, the front portion of the pan (17A) will smooth out the concrete below it and the concrete in the gap will be smooth until the hydraulic cylinders (25) within housing (35) telescope to push the inserting forks (28) from the up position shown in FIG. 1 to the down position shown in FIG. 2 wherein all of the dowel bars (49) which are in their holders (24) and held in place by spring tabs (26) will be pushed straight down into the concrete (14) to the predetermined depth programmed into the controller (55) of the machine. This will be similar to the situation shown in FIG. 5 of the Godbersen U.S. Pat. No. 5,209,602.

Figure 3:
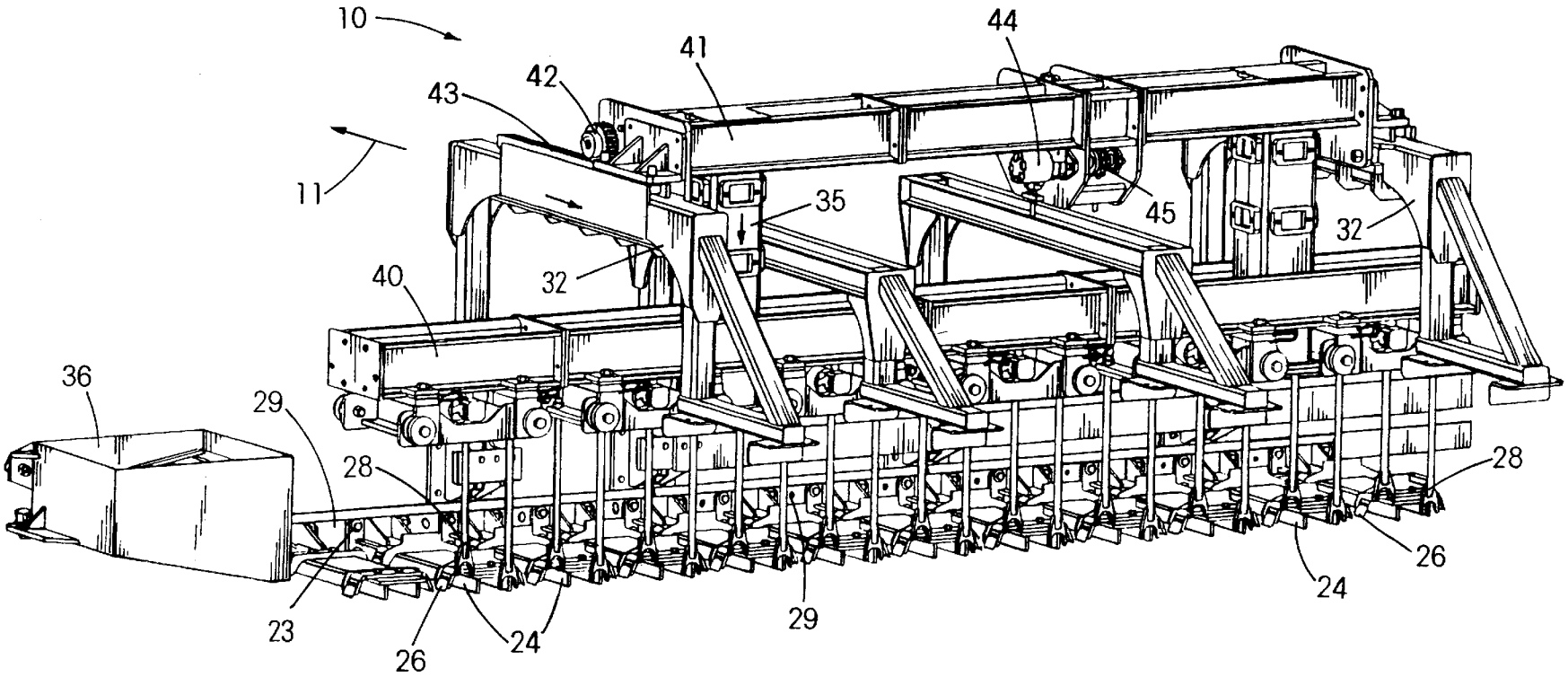
FIG. 3 is a perspective view across the entire machine but having a portion of the pan removed.
Figure 4:
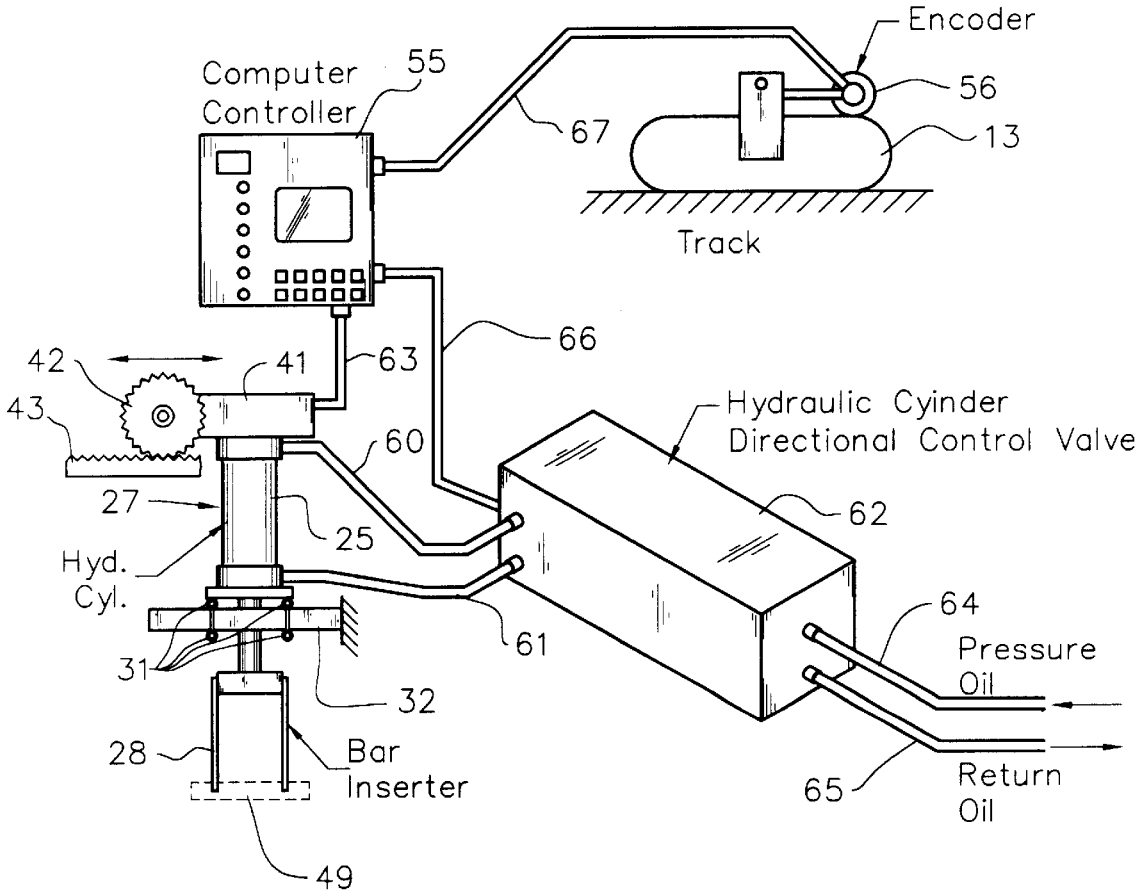
FIG. 4 is a schematic view of the system to insert dowel bars.

Referring now to FIG. 3, it is noted that the trolley (36) can automatically drop dowel bars therein in each of the holders (24) all the way across the machine in the manner shown in the Bengford, et al., patent referred to above. Then when it is time for the forks (28) to push the dowel bars into the slab, the forks (28) will move forwardly from the FIG. 3 position to the FIG. 1 position, because they are attached to beams (40) and these beams (40) are attached by the hydraulic cylinders (25) and posts (35) to the overhead beam (41). This overhead beam (41) has a rod (not shown) extending completely therethrough and this rod has a gear (42) rigidly attached to each end thereof. This gear (42) engages a rachet (43) on each end of the machine. A motor (44) through a gear box (45) rotates the rod and therefore the gears (42). A computer (55) as shown in FIG. 4 monitors the speed and position of the paver track (13) through encoder (56) and this information is feed into the computer (55) to operate the motor (44) and hydraulic cylinder (35) at appropriate times.

In operation, after the dowel bars (49) are inserted, the trolley (36) will be actuated by the computer (55) to load the holders (24) and spring members (26) again. The forks (28) will generally be rearward in the position shown in FIG. 3. These forks (28) will be moved forwardly by a signal from computer (55) to cause motor (44) to move the rod and gear (42) so that the forks (28) will move forwardly so that they are over the dowel bar holders (24) to the position shown in FIG. 1.

Once the computer (55) signals through line (66) to valve (62) that it is time to insert the dowel bars (49), a fluid will flow to and from the hydraulic cylinder (35) control valve (62) through lines (60) and (61) and the bars (49) will be pushed into the concrete. Lines (64) and (65) are pressure and return lines respectively. During this process, the motor (44) will be turning to keep the forks (28) in the same ground plane position with respect to the concrete (14) that it was when it first entered the concrete (14), even though the machine is moving forwardly. This is done by moving the beam (41) on beam (32) and guide rollers (31) through gears (42), since the forks (28) are ultimately hooked to the bottom of this beam (41). As the machine (10) continues to move forwardly, the forks (28) remain in the same place (except for up and down movement) in the concrete slab (14) but move rearwardly with respect to the gap portion of the machine (10) as shown in dashed lines in FIG. 2, at which time the forks (28) are then raised by the hydraulic cylinders (35) when signaled to do so by the computer (55). Once the forks (28) are raised back to the position shown in FIG. 3, the cycle can repeat itself again and again as controlled by the computer (55).

If it is desired to adjust the distance between dowel bars in the concrete (14), the dowel bar retainers (24) can be adjusted by removing bolts (25) and putting them into different openings (29) as shown in FIGS. 1 and 3 or by other adjusting mechanisms, such as a slide bar clamping the dowel bar retainers to it. Any adjustment to the position of dowel bar retainers (24) requires a corresponding adjustment in the lateral position of the insertion forks (28) which can be done by moving the bolts (37) shown in FIG. 1 to a different opening in members (39) or by other mechanisms to make the adjustment correspond to the position of the dowel bar retainers (24).

Figure 5:
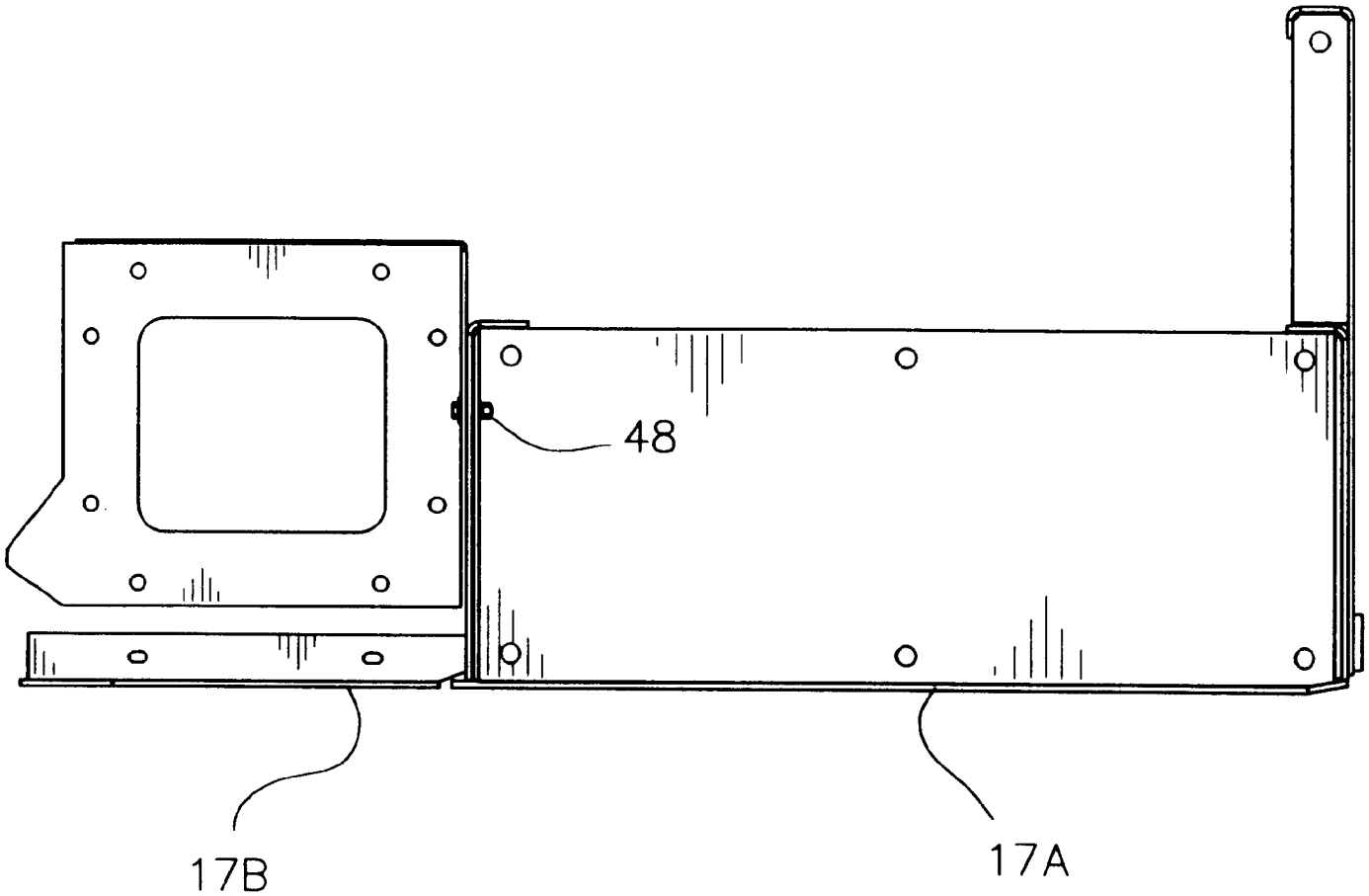
FIG. 5 is a side view of the invention having the dowel bar retainer, inserter and actuator removed and the front and rear portions of the pan bolted together.

When it is desired to utilize the slip forming machine without utilizing the dowel bar inserter (27), the rear pan (17A) is unbolted from the overhead structure and the dowel bar inserter (27) is removed from the front pan (17A) by bolts. Then the rear portion (17B) of the pan is attached to the front portion (17A) of the pan by bolts or threaded fasteners (40) as shown in FIG. 5. In the FIG. 5 configuration, the slip forming machine can be utilized without inserting dowel bars. The beauty of this adjustment is that the slip forming machine can be purchased in the FIG. 5 configuration without the additional expense of the dowel bar inserting mechanism (27) and then, at a later time, the insertion mechanism (27) can be purchased. Alternatively, a contractor who knows that he may need to use a dowel bar inserter at some time but knows that it is not required at other times can derive significant economic benefit from having this adjustable feature which allows the dowel bar inserter to be used or not used.

Accordingly, it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A concrete slip forming apparatus comprising:

a frame having a longitudinally axis, said frame being adapted to be moved in a forward direction;

a vibrator attached to said frame for consolidating uncured concrete;

a pan attached to said frame behind said vibrator for shaping the uncured concrete into a continuous concrete slab, said pan having a front portion and a rear portion, said front and rear portions of said pan being spaced apart to form a space between said front and rear portions of said pan;

dowel bar retainer operatively attached to said frame between said spaced apart front and rear portions of said pan for holding a dowel bar in readiness to be inserted into said concrete slab, said dowel bar retainer being disposed above said space between said front and rear portions of said pan;

an inserter disposed above said dowel bar retainer, said inserter being operatively attached to said frame for pushing dowel bars disposed in said dowel bar retainer into said concrete slab; and an actuator for causing said inserter to insert dowel bars at predetermined places into said concrete slab whereby said dowel bars disposed in said retainer can be positioned in the concrete across said concrete slab.

2. The apparatus of claim 1 including means for permitting said dowel bar retainer, inserter and actuator to be removed and the front and rear portions of the pan to be attached together when it is desired to slip form concrete without using dowel bars.

3. The apparatus of claim 1 including means for adjusting the distance between dowel bar retainers.

4. The apparatus of claim 3 including means for adjusting the distance between inserters.

5. A concrete slip forming apparatus comprising:

a frame having a longitudinal axis, said frame being adapted to be moved in a forward direction;

a vibrator attached to said frame for consolidating uncured concrete;

a pan attached to said frame behind said vibrator for shaping the uncured concrete into a continuous concrete slab, said pan having a front portion and a rear portion, said front and rear portions of said pan being spaced apart to form a space between said front and rear portions of said pan, said front portion of said pan being longer than said rear portion of said pan in a direction parallel to said longitudinal axis;

an inserter disposed above said dowel bar retainer, said inserter being operatively attached to said frame for pushing dowel bars disposed in said dowel bar retainer into said concrete slab; and an actuator for causing said inserter to insert dowel bars at predetermined places into said concrete slab whereby said dowel bars disposed in said retainer can be positioned in the concrete across said concrete slab.

6. The apparatus of claim 5 including means for permitting said inserter and actuator to be removed and the front and rear portions of the pan to be attached together when it is desired to slip form concrete without using dowel bars.

7. The apparatus of claim 5 including means for adjusting the distance between dowel bar spacings.

8. The apparatus of claim 7 including means for adjusting the distance between inserters.

9. A concrete slip forming apparatus comprising:

a frame having a longitudinal axis, said frame being adapted to be moved in a forward direction;

a vibrator attached to said frame for consolidating uncured concrete;

a pan attached to said frame behind said vibrator for shaping the uncured concrete into a continuous concrete slab, said pan having a front portion and a rear portion, said front and rear portions of said pan being spaced apart to form a space between said front and rear portions of said pan;

an inserter disposed above said dowel bar retainer, said inserter being operatively attached to said frame for pushing dowel bars disposed in said dowel bar retainer into said concrete slab;

an actuator for causing said inserter to insert dowel bars at predetermined places into said concrete slab whereby said dowel bars disposed in said retainer can be positioned in the concrete across said concrete slab; and means for permitting said inserter and actuator to be removed and the front and rear portions of the pan to be attached together when it is desired to slip form concrete without using.

* * * * *

UNITED STATES PATENT AND TRADEMARK OFFICE

CERTIFICATE OF CORRECTION

PATENT NO. : 6,099,204
DATED : August 8, 2000
INVENTOR(S) : Gary L. Godbersen

It is certified that error appears in the above-identified patent and that said Letters Patent is hereby corrected as shown below:

Column 1,
Line 65, of the issued Patent, delete "inserting" and susbstitute -- inserter -- therefor.

Column 3,
Line 19, of the issued Patent, after the word gap, delete "A" and substitute -- (A) -- therefor.
Line 21, of the issued Patent, please delete "formed essentially by" and substitute -- and -- therefor.
Line 33, of the issued Patent, please delete "11" and substitute -- (11) -- therefor.
Line 63, of the issued Patent, please change "35" to -- 25 --.

Column 4,
Lines 9 and 25, of the issued Patent, please change "35" to -- 25 --.
Line 31, of the issued Patent, please change "25" to -- 23 --.
Line 43, of the issued Patent, please change "(17A)" to -- (17B) --.
Line 47, of the issued Patent, please change "(40)" to -- (48) --.

Column 5,
Line 1, of the issued Patent, please change the word "longitudinally" to -- longitudinal --.
Line 11, of the issued Patent, before the word dowel, please add the letter -- a --.

UNITED STATES PATENT AND TRADEMARK OFFICE

CERTIFICATE OF CORRECTION

PATENT NO. : 6,099,204
DATED : August 8, 2000
INVENTOR(S) : Gary L. Godbersen

It is certified that error appears in the above-identified patent and that said Letters Patent is hereby corrected as shown below:

Column 6,
Line 3, of the issued Patent, please delete the words "dowel bar retainer" and substitute the word -- space -- therefor.
Line 5, of the issued Patent, please delete "disposed in said dowel bar retainer".
Line 9, of the issued Patent, please delete "disposed in said retainer".
Line 30, of the issued Patent, please delete "dowel bar retainer" and substitute -- space -- therefor.
Line 32, of the issued Patent, please delete "disposed in said dowel bar retainer".
Line 36, of the issued Patent, please delete "disposed in said retainer".
Line 41, of the issued Patent, after the word using, please add -- dowel bars --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*